United States Patent [19]

Arndt

[11] 4,020,746

[45] May 3, 1977

[54] HYDRAULICALLY OPERABLE LINEAR MOTOR

[75] Inventor: Friedrich Karl Arndt, Essen, Germany

[73] Assignee: Fried. Krupp Gesellschaft mit beschrankter Haftung, Essen, Germany

[22] Filed: Dec. 3, 1975

[21] Appl. No.: 637,465

[30] Foreign Application Priority Data

Dec. 14, 1974 Germany ..... 2459210

[52] U.S. Cl. ..... 91/291; 91/300; 91/321

[51] Int. Cl.[2] ..... F01L 25/04; F01B 7/18

[58] Field of Search ..... 91/300, 321, 291

[56] References Cited

UNITED STATES PATENTS

| | | | |
|---|---|---|---|
| 3,322,038 | 5/1967 | Dobson | 91/300 |
| 3,552,269 | 1/1971 | Arndt | 91/300 |
| 3,774,502 | 11/1973 | Arndt | 91/321 |

*Primary Examiner*—Paul E. Maslousky

*Attorney, Agent, or Firm*—Walter Becker

[57] ABSTRACT

A hydraulically operable linear motor with a double-acting reciprocable piston in a cylinder, in which one side of the piston has connected thereto a piston rod so as to form with this one side an annular piston surface which is continuously exposed to a desired working pressure. The other side of the piston is by means of a hydraulically actuated control valve alternately exposed to the working pressure and to the pressure in an exhaust conduit. The pressure for actuating the valve spool of the control valve is generated in a conduit section which communicates with two annular grooves in the two cylinder sections separated from each other by the piston and adapted alternately to be closed off from the above mentioned conduit section. This conduit section communicates through throttles with the exhaust conduit. The annular groove located in that cylinder section which is defined by the annular piston surface and the cylinder end wall faced thereby communicates through a preloaded check valve with the exhaust conduit.

2 Claims, 1 Drawing Figure

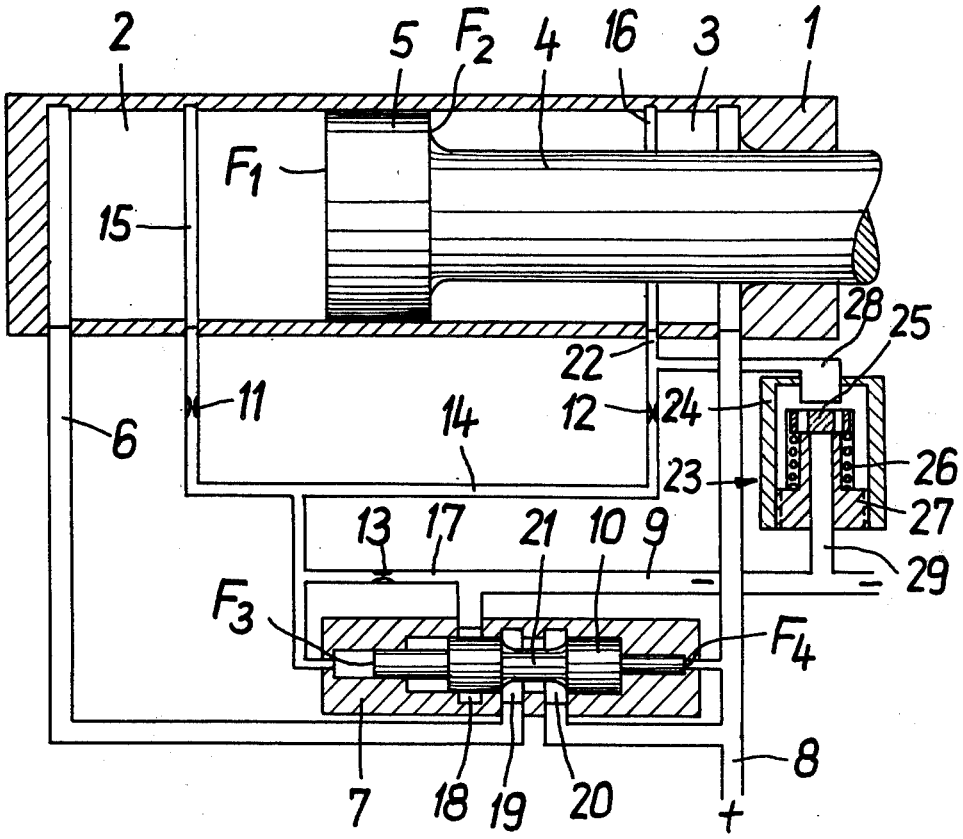
2
5
F2
4
16
3
1
F1
15
28
25
22
11
12
24
6
14
23
26
27
13
17
21
10
9
29
F3
F4
8
7
18
19
20
+

HYDRAULICALLY OPERABLE LINEAR MOTOR

The present invention relates to an improvement of the hydraulically operable linear motor set forth in U.S. Pat. No. 3,552,269. This patent concerns a hydraulically operable linear motor with reciprocable piston. The piston of said motor, which is connected to a piston rod, has an annular piston surface which is continuously subjected to the working pressure whereas the oppositely located end face of said piston is by means of a hydraulically operable control valve alternately connected to the working pressure and the exhaust pressure. The variable control pressure for actuating the valve spool of said control valve is generated in a conduit section which is adapted to communicate with two annular grooves in the working cylinder as well as with the discharge conduit through hydraulic throttles respectively, said two annular grooves being alternately covered by the reciprocating piston.

It is an object of the present invention with a linear motor of the above mentioned type to shorten the reversing time, which means the time required by the valve spool for its movement from one end position to the other end position. This is important in order to be able to operate hydraulic linear motors at as high a frequency as possible.

This object and other objects and advantages of the invention will appear more clearly from the following specification in connection with the accompanying drawing diagrammatically illustrating a longitudinal section through a hydraulically operable linear motor according to the present invention.

The hydraulically operable linear motor according to the present invention is characterized primarily in that the annular groove located in that section of the working cylinder which is continuously subjected to the working pressure is adapted additionally through the intervention of a preloaded check valve to communicate with the discharge conduit.

By arranging the additional check valve, it has been made possible to obtain the pressure drop at the one end face of the valve spool at a considerably faster rate than would be the case by a suitable change in the throttle cross section alone as it is suggested by my above mentioned U.S. Pat. No. 3,552,269.

Referring now to the drawing in detail, the working cylinder 1 of the linear motor comprises two cylinder sections 2 and 3 which are separated from each other by the piston 5 connected to the piston rod 4. The end face $F_1$ of piston 5 defines one end of the working chamber 2 which through a conduit 6 and the control valve 7 is alternately connected to the pressure line 8 or the discharge conduit 9. The annular surface $F_2$ of piston 5, which annular surface is less than the surface $F_1$ by the cross section of the piston rod, 4, defines one end of the working chamber 3, which latter continuously communicates with the pressure line 8.

When as illustrated in the drawing the working chamber 2 communicates with the pressure line 8, the piston 5 moves toward the right with regard to the drawing. If on the other hand the connection of the conduit 6 with the discharge conduit 9 is established, the piston 5 moves toward the left with regard to the drawing. The movement of the valve spool 10 in the control valve 7, which movement is necessary for reversing the movement of piston 5, is effected hydraulically in the following manner:

A conduit section 14 is through hydraulic throttles 11, 12 and 13 connected to two annular grooves 15 and 16 provided in the working cylinder 1, and is furthermore connected to a conduit 17 leading into the discharge conduit 9. The control pressure $P_{st}$ generated in said conduit section 14 acts upon the end face $F_3$ of the valve spool 10, whereas the working pressure $P_o$ continuously acts upon the valve spool surface $F_4$ which is somewhat smaller than the valve spool surface $F_3$. The cylindrical inner chamber of the control valve 7 is provided with three annular grooves 18, 19 and 20 which respectively communicate with the discharge conduit 9, the feeding conduit 6 and the pressure conduit 8. The valve spool 10 has an intermediate recess 21.

At a certain control pressure $P_{stO}$, which is less than the working pressure $P_o$, the forces acting upon the valve spool surfaces $F_3$ and $F_4$ cancel each other out. At an increased pressure $P_{st}$, the valve spool 10 moves into the right-hand position shown in the drawing in which the left-hand working chamber 2 of the working cylinder 1 communicates through the feeding conduit 6, annular groove 19, recess 21, and annular groove 20 with the pressure conduit 8. At a reduced control pressure $P_{st}$, the valve spool 10 moves into its right-hand end position (with regard to the drawing) in which the working chamber 2 through feeding conduit 6, annular groove 19, recess 21, and annular groove 18 communicates with the discharge conduit 9.

The change in the control pressure $P_{st}$ is brought about by the fact that the piston 5 which reciprocates in the working cylinder 1 covers or frees the annular grooves 15 and 16, and more specifically, in the following manner.

As has already been mentioned, in the illustrated position, the left-hand working chamber 2 communicates with the pressure conduit 8. Thus, in both working chambers 2 and 3, the same pressure $P_o$ prevails, and inasmuch as $F_1$is greater than $F_2$, piston 5 moves toward the right with regard to the drawing. Moreover, in the conduit section 14, the greatest possible control pressure $P_{st}$ is generated inasmuch as the full working pressure $P_o$ acts upon both throttles 11 and 12.

As soon as with the piston movement toward the right, the annular groove 16 is covered by piston 5, the pressure $P_o$ acts only upon the throttle 11. Therefore, $P_{st}$ drops to a value which is substantially determined by the design of the hydraulic throttles 11 and 13, which means by the cross sections thereof. These cross sections are not changeable at will because otherwise the reversing of the piston in its left-hand end position in the working cylinder 1 is not effective. This fact brings about that the control pressure $P_{st}$ can drop only slightly below the pressure $P_{stO}$ at which pressure the forces acting upon the end faces $F_3$ and $F_4$ of the valve spool 10 just cancel each other out or balance each other.

In order, nevertheless, to be able to determine the control pressure $P_{st}$ to drop still further, conduit 22, which connects the conduit section 14 through the hydraulic throttle 12 with the annular groove 16 of cylinder 1, in conformity with the invention, is adapted additionally to be connected through a preloaded check valve 23 with the discharge conduit 9. This check valve 23 is so set that it opens as soon as the control pressure $P'_{st}$ in the conduit section 14 drops somewhat below the equilibrium pressure $P_{stO}$. As soon as this happens, the conduit section 14 is no longer through throttle 13 alone, but also through throttle 12, connected to the discharge conduit 9 so that the control pressure can drop further. As a result thereof, the force acting upon the left-hand end face $F_3$ of the valve spool 10 is considerably less, and the valve spool accordingly moves faster into its left-hand end position in which the working chamber 2 and thus also the throttle 11 communicates with the discharge conduit 9. The control pressure $P_{st}$ will thus drop still further. The piston 5, due to the pressure $P_o$ exerted upon the annular surface $F_2$, moves toward the left and first frees the annular groove 16 whereby $P_{st}$ increases again but still remains below the value $P_{stO}$.

As soon as the piston 5 covers up the annular groove 15, the control pressure $P_{st}$ rises again. When this control pressure exceeds the value $P_{stO}$, the valve spool 10 moves again into its right-hand end position, and the next piston stroke toward the right will start.

In the illustrated embodiment of the invention, the preloaded check valve 23 comprises a housing 24 in which a movable sealing plate 25, either by means of a preloaded spring 26 resting on an axially adjustable closure member 27, is pressed against the end of an upper connecting pipe 28, which communicates with conduit 22, or at sufficient pressure in pipe 28 is against the thrust of spring 26 pressed against the end of a connecting pipe 29 which communicates with the discharge conduit 9. In the first instance, the check valve 23 is opened, whereas in the second instance illustrated in the drawing, the check valve 23 is closed. The first instance occurs only when during the movement of the piston 5 in the working cylinder 1 the annular groove 16 is covered up and in the conduit 22 thus separated from the pressure conduit 8, the pressure has dropped sufficiently below the working pressure $P_o$. During the entire remaining time, the check valve 23 remains closed.

By axially adjusting the closure member 27, which may be a threaded element meshing with a corresponding thread in the housing 24, the force of the preloaded spring 26 may be varied and thereby the reversing time for the valve spool 10 and thus the frequency of operation of the reversal of the piston 5.

It is, of course, to be understood that the present invention is, by no means, limited to the specific showing in the drawing but also comprises any modification within the scope of the appended claims.

What I claim is:

1. A hydraulically operable linear motor, which includes in combination: a cylinder having first and second end walls respectively arranged at opposite ends of said cylinder, a double-acting piston reciprocally mounted in said cylinder a piston rod extending through said first end wall and being connected to that side of said piston which faces said first end wall so as to form on said one side an annular piston surface, said annular piston surface forming with said first cylinder end wall a first cylinder chamber, first conduit means leading into said first cylinder chamber for continuously conveying fluid pressure onto said annular piston surface when said first conduit means is connected to a source of fluid pressure, that side of said piston which is opposite said annular piston surface forming with said second cylinder end wall a second cylinder chamber, second conduit means leading into said second cylinder chamber, control valve means interposed between said first and said second conduit means, an exhaust line communicating with said control valve means, said control valve means being movable to a first position to connect said second conduit means to said first conduit means, and also being movable to a second position to connect said second conduit means to said exhaust line, said control valve means including a valve spool with first surface means for continuous communication with said first conduit means, said first surface means being fluid pressure operable to move said control valve means into said second position, said valve spool also having second fluid operable surface means for moving said control valve means to said first position, a fluid conveying control conduit system having first line means and second line means respectively leading into said first and second cylinder chambers at two points respectively located between said first and second cylinder end walls on one hand and said piston in its central position between its end positions on the other hand, said control conduit system also including third line means communicating with said second fluid operable surface means and also including fourth line means communicating with said exhaust line, said control valve means furthermore including first passage means communicating with said first conduit means and also including second passage means communicating with said second conduit means, and furthermore including third passage means communicating with said fourth line means, said first, second and third passage means being controlled by said valve spool, throttle means respectively arranged in said first, second and fourth line means, and preloaded check valve means interposed between said first line means and said exhaust line for establishing communication between said first line means and said exhaust line and to interrupt said last mentioned communication in response to said piston interrupting communication of said first line means with said first cylinder chamber.

2. A motor in combination according to claim 1, in which said preloaded check valve means includes a pre-loading spring and means for adjusting said spring.

* * * * *